United States Patent [19]

Goad et al.

[11] Patent Number: 4,822,667

[45] Date of Patent: Apr. 18, 1989

[54] WOVEN MEDICAL FABRIC

[75] Inventors: Conrad D. Goad, Greensboro, N.C.; Jeffrey L. Taylor, Cincinnati, Ohio

[73] Assignees: Precision Fabrics Group, Greensboro, N.C.; Standard Textile Co., Inc., Cincinnati, Ohio

[21] Appl. No.: 164,197

[22] Filed: Mar. 4, 1988

[51] Int. Cl.[4] ..... B32B 7/00

[52] U.S. Cl. ..... 428/265; 428/224; 428/225; 428/421; 428/913; 428/920

[58] Field of Search ..... 2/DIG. 7; 139/420 A, 139/420 R, 426 R; 428/225, 224, 265, 421, 913, 920

[56] References Cited

U.S. PATENT DOCUMENTS 4,525,409 4/1985 Elesh ..... 428/193

4,561,434 7/1985 Taylor ..... 128/155

*Primary Examiner*—James J. Bell

*Attorney, Agent, or Firm*—Nixon & Vanderhye

[57] ABSTRACT

Reusable, launderable, sterilizable medical barrier fabric tightly woven from 100% polyester fiber constructed of polyester yarn of from 50 to 150 denier, the sum of the ends and picks of at least 100 per linear inch, is treated with a flame-resistant, water repellent, antimicrobial finish. Medical garments, wraps and like sterilizable articles constructed of this fabric retain their desirable properties after repeated institutional launderings and/or steam sterilizations.

14 Claims, No Drawings

WOVEN MEDICAL FABRIC

BACKGROUND OF THE INVENTION

This invention relates to medical fabrics, particularly fabric used to make surgical gowns, surgical scrub suits, sterilization wrappers (CSR wrap), cover gowns, isolation gowns, hamper bags, jump suit, work aprons, laboratory coats and the like. The fabric is especially suited as a barrier to prevent or control the spread of infectious microorganisms. The invention also includes processes for making a woven medical fabric.

There are currently two types of medical fabrics—disposable and reuseable. Disposable fabrics are typically constructed from nonwovens made from light weight synthetic fibers or synthetic fibers blended with natural fibers. Performance of disposable nonwoven fabrics in terms of liquid repellency and flame retardancy are quite acceptable. Reusable fabrics are woven and may be constructed from cotton or cotton/polyester blends of a high thread count to provide a physical barrier to prevent or reduce the spread of infectious materials and vectors. While reusable woven fabrics offer more comfort in terms of drapeability, breathability, transmission of heat and water vapor, stiffness, etc., and improved (reduced) cost per use, they lack the liquid repellency and flame retardancy the market has come to expect on the basis of experience with the disposables, especially after repeated launderings and/or steam (autoclave) sterilizations.

This invention provides a woven, resuable, direct finished single layer medical fabric made of 100% polyester fiber. The fabric exhibits the desirable properties of both the nonwoven disposables and woven reusable fabrics. The fabric has very low lint or particle generation, is a barrier with improved alcohol repellency, improved soil and oil repellency, is a generally more robust, abrasion-resistant fabric, yet has a soft hand, antimicrobial and antistatic properties, flame resistant, increased repellency to water, yet durably finished to be fully launderable and, if necessary, also autoclave sterilizable for numerous cycles. Procedures for finishing such fabric and finishing solutions for use in such procedures are also described.

DESCRIPTION OF THE INVENTION

To be competitive in the marketplace, woven reusable surgical barrier fabrics must meet or exceed the current criteria for National Fire Protection Association (NFPA-99) and the Association of Operating Room Nurses (AORN) "Recommended Practices—Aseptic Barrier Material for Surgical Gowns and Drapes" used in constructing operating room wearing apparel, draping and gowning materials. To be effective, the fabric must be resistant to blood and aqueous fluid (resist liquid penetration); abrasion resistant to withstand continued reprocessing; lint free to reduce the number of particles and to reduce the dissemination of particles into the wound; drapeable; sufficiently porous to eliminate heat buildup; and flame resistant. Reusable fabrics should withstand multiple laundering and, where necessary, sterilization (autoclaving) cycles; non-abrasive and free of toxic ingredients and non-fast dyes; resistant to tears and punctures; provide an effective barrier to microbes, preferably bacteriostatic in their own right; and the reusable material should maintain its integrity over its expected useful life.

The products of this invention, measured against the recommendations and standards listed above, have the following properties assessed initially and after 100 institutional laundering or laundering and sterilization cycles.

1. Hydrostatic resistance, a measure of the fabric's resistance to penetration by blood and aqueous solutions, is measured using the Suter hydrostatic resistance test. Preferably initial readings are at least 20.0 (absolute) and 10.0 after 100 cycles and preferably an initial reading of at least 35.0 and at least 20.0 after 100 cycles.

2. Linting—barrier medical fabrics should be as lint free as possible to reduce the dissemination of lint particles into wounds and into the surrounding environment. Linting is measured by the International Nonwovens and Disposables Association (INDA) test 160-0-83 (1.0 micron, 10 minutes) with initial values of less than 5,000 lint particles and less than 2,000 lint particles after 100 laundering/sterilizing cycles.

3. Flame resistance is a desirable, but not an essential (in some cases) property of barrier fabrics. Flame resistance is measured according to NFPA 702. This test measures the time a material takes to burn up a 45° incline; a longer time indicates a less flammable fabric. The fabric must be classified by this test as Class II initially and following 100 laundry/sterilization cycles.

4. Oil repellency, an indicator of soil release properties, is measured according to INDA 80.8 with initial values in the 3-8 range, preferably about 4. The fabric may lose its oil repellency as the fluorocarbon water repellent and other treating agents are leached out of the fabric over time.

5. Steam penetration—while a high thread count, tightly woven fabric is desirable in medical fabrics for its barrier properties, the fabric must also be amenable to steam sterilization both initially and following 100 cycles. This is especially true of medical fabrics such as surgical gowns, sterilization wrappers, surgical drapes and covers and other fabric products used in a sterile envionment.

6. Colorfast—when a fabric is dyed to provide an attractive nonglare color that minimizes distortion from reflected light, the dye must remain on the fabric, be crock free and retain its color (fastness) following multiple launderings and, optionally, steam sterilizations. The fabrics of this invention have a colorfastness following 50 cycles of at least 2.5 according to AATCC 8-1981.

7. Antimicrobial activity of the fabric is assessed using CTM-0923. There is no growth initially, and preferably at least a 90% kill, and no growth after 100 cycles.

8. Spray ratings—another way to assess water repellency is using the AATCC-22-1980 spray test in which the fabric initially has a water spray of an absolute value of at least 70 (on a scale 0 to 100). Water resistance diminishes following multiple launderings eventually to 50.

9. Alcohol repellency is another desirable, but not essential, property and this is measured using INDA 80.9. Initial values should be an absolute value of at least 6 (on a scale of 0–10) but can be expected to decrease following multiple launderings.

10. Air permeability—Frazier method—is used to assess the barrier properties of the fabric usually during production. Air permeability of less than 5 initially and at most 10 cubic feet per minute per square foot of fabric sample at 0.5 inch water after 100 laundry cycles measured according to Federal Test Method FTM 5450.

These and related properties may be assessed using diverse testing methods and quantification procedures, and evaluations may be made following any given number of washing/drying or laundry/sterilization cycles.

The medical fabric of this invention may have essentially two performance levels. Medical garments or products subjected to institutional washing and drying operations constructed from medical fabrics of this invention are quite satisfactory and represent an advancement when their water repellency is a minimum of 20 as tested on Suter hydrostatic test AATCC 127 initially. Other types of medical products and apparel require a higher level (on the order of 30 cm Suter hydrostatic test) to provide a satisfactory level of repellency.

After 100 laundering and autoclave sterilization cycles, these values are as follows:

| | Initial | After 100 Cycles |
|---|---|---|
| Linting (INDA 160-0-83) | 5000 Max. | 2000 Max |
| Flammability (NFPA 702) | Class II | Class II |
| Oil Repellency* (INDA 80.8) | at least 3 | 0 |
| Antimicrobial Activity (CTM-0923) *Klebsiella Pneumoniae* | No Growth | No Growth |
| Alcohol Repellency* (INDA 80.9) | at least 6 | 0 |
| Suter Hydrostatic (AATCC-127), cm. | 20.0 | 10.00 |
| Spray Rating* (AATCC-22-1980) | at least 70 | at least 50 |
| Frazier Air Permeability (FTM 5450) cfm/ft$^2$ @ ½" $H_2O$ | less than 5 | less than 10 |

*optional properties

Fabric construction is important to a successful product. The medical fabric used in this invention is woven from 100% polyester filament yarn (nylon lacks durability and is unsuited to this invention) with an optimum, predetermined fabric density. Fabric density is a function of the fabric construction in which yarn denier, number of ends and number of picks (thread count) per linear inch are the essential variables. For general purposes, the yarn denier will fall in the range of from 50 to 150 in combination with a sum of the ends and picks (sometimes called a "round count") of at least 100 per inch. The following Table will provide guidance for appropriate range of fabric construction.

| | Denier | Ends | Picks |
|---|---|---|---|
| Max. | 50 | 162 | 108 |
| Min. | 50 | 108 | 72 |
| Max. | 70 | 137 | 191 |
| Min. | 70 | 190 | 60 |
| Max. | 100 | 116 | 76 |
| Min. | 100 | 76 | 50 |
| Max. | 150 | 94 | 62 |
| Min. | 150 | 62 | 42 |

The woven fabric, prior to finishing, has a weight of from about 2 to 10 ounces per square yard, preferably 2 to 3 ounces per square yard with 2.5 the most desired value.

Prior to treating, we recommend washing, drying and otherwise removing any lint that may be attached to or embedded in the fabric.

The polyester woven fabric of appropriate construction is finished with a treatment bath which may be applied using any convenient textile finishing operation and textile finishing equipment. Our equipment and experiences are specific to applying the treatment from a pad bath followed by subsequent processing in open width as explained in more detail below. Other methods of application including spraying, brushing, exhaust, etc., readily recognized by those skilled in this art may be used.

In overview, the pad bath contains the following types of ingredients; some listed below are optional ingredients, as indicated:

| Ingredient | Amount (wt. %) |
|---|---|
| non-rewetting surfactant | .025–2.0 |
| fluorocarbon water repellent | 2.0–15.0 |
| flame retardant* | 1.0–20.0 |
| antimicrobial agent | 0.5–5.0 |
| antistatic compound* | 0.5–10.0 |
| citric acid* | 0.01–1.0 |
| disperse dye* | 0.01–3.0 |
| pad pickup (owf) | 40~100% |

*optional

Components of the pad bath serve various purposes and are readily available from several commercial sources.

Surfactants, to lower the surface tension of the water, a major ingredient of the bath, suited to the invention are of the non-rewetting type. The following surfactants are suggested: fatty acid amines, Mykon NRW3 (Sequa); alcohols, Penetrant KB (Burlington Industries, Chemical Division); nonionic emulsions, Alkanol 6112 and Avitex 2153 (DuPont).

The fluorocarbon water repellent component is typically a dispersion of fluoropolymer in water (see generally Fluorine-Containing Polymers, Encyclopedia of Polymer Science & Technology, pp. 179-203, Interscience, 1967, the disclosure of which is hereby incorporated by reference). The fluoropolymer component may be selected from a host of commercially available products including DuPont's Zonyl NWG, Zonyl NWN, Zepel 6700, and 3-M's FC-834, FC-461 and FC 232. It is the fluorocarbon component that provides the water and fluid repellency to the finished fabric. One will select a repellent fluorocarbon component that is compatible with the system, i.e., the other bath components and processing conditions, is economical and provides the required degree of liquid repellency. A wax extender for the fluorocarbon may be incorporated in the formulation as required.

Flame retardants may be included in the formulation to impart flame resistance to the treated fabric. A variety of flame retardants are commercially available for cotton, synthetic and cotton/synthetic blended fabrics. We find those flame retardants convenient that can be added to a single finish formulation and do not require a separate processing step or steps to attach the flame retardant to the fibers. A preferred class of flame retardants are the cyclic phosphonate esters, a group of known flame retardants as described in U.S. Pat. Nos. 3,789,091 and 3,849,368. Antiblaze 19 and Antiblaze 19T are commercially available cyclic phosphonate ester flame retardants from Albright & Wilson. Other flame retardants suitable for this invention are Glo-Tard NTB (Glo-Tex) and Flameproof #1525 (Apex); all are organophosphates.

An antimicrobial agent is included in the treatment formulation for its obvious properties of preventing infectious substances and vectors from contaminating patients and others. As a class, members of the organosilicones (a preferred group of antimicrobial agents) exhibit antimicrobial activity and have the required regulatory clearances for use in hospital and medical fabrics.

The preferred organosilicone antimicrobial is 3-(trimethoxysilyl)-propyloctadecyldimethyl ammonium chloride. A class of suitable bioactive organosilicone compounds have the formula:

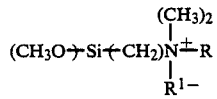

in which R is a $C_{11-22}$ alkyl group and $R^1$ is chlorine or bromine. The preferred silicone quaternary amine is 3-(trimethoxysilyl)- propyloctadecyl dimethyl ammonium chloride ($R=C_{18}H_{38}$, $R^1=Cl$) which is described in U.S. Pat. No. 3,730,701, the disclosure of which is hereby incorporated by reference, and is available as a 42% active solids in methanol from Dow Corning Corporation of Midland, Mich. under the designation DC-5700 or Sylgard 5700. This material is well accepted in commerce and has been approved not only as a bacteriostatic textile treatment but also as a bactericidal component for medical device/non-drug applications. Another suitable antimicrobial is Sanitized Plus (Sandoz) also an organosilicone.

The quantity of antimicrobial agent included in the pad bath formulation is dependent upon its durability to laundering and the degree of antimicrobial protection desired. Generally, the amount will be in the range of from about 0.5 to about 5.0% calculated on the weight of the entire mix.

Antistatic compounds may be included in the pad bath to enable the treated fabric to dissipate static electricity, particularly in surgical environments where combustible gases are present. Suitable antistats are quaternary ammonium compounds, such as Aerotex CSN (American Cyanamid), and the alkyl amines, such as Aston 123 (Hi-Tek Polymers).

Medical fabrics are usually dyed to give them a pleasing appearance and to color code the level of use to which the product is suited. Dyes present in the pad bath must remain on the fabric and resist crocking and bleeding even following multiple institutional laundering and autoclaving. Disperse dyes satisfy these requirements. Citric acid may be used in the bath to lower the pH and thus to assist dyeing.

The above is a typical pad bath formulation. The amount of bath of this general formulation applied to and taken up by the fabric is usually in the range of from about 40% to about 100% and is expressed on the weight of the fabric. For the above formulation, the ingredients are added to the required quantity of water in the following order; citric acid, surfactant, disperse dye, organosilicone compound (previously pre-diluted 50%), antistatic compound, fluorocarbon water repellent and flame retardant.

After the fabric is treated with the aqueous formulation, it is dried to remove moisture before further processing.

The dried, treated fabric is then passed between a set of heated (about 300° to 400° F.) steel rolls and pressed with force sufficient to lower the air permeability of the fabric. Calendering gives the polyester yarn permanent mechanical properties, makes the fabric more dense thereby lowering air permeability without adding to the cost of construction. It closes the interstitial pores and flattens the fabric surface. The effect of calendering is measured by air permeability of the treated fabric. An air permeability of between about 0.5 and 2.0 cfm (Frazier method) is required for most fabric applications. Calendering is an optional but cost saving process, and enables the use of a less densely constructed fabric. Calendering temperatures must exceed the washing, drying and autoclaving tempeatures the finished medical fabric will experience in use. Generally the fabric must be exposed to a temperature of at least 300° F.; the upper limit is set by the melting point of the polyester fibers of the scorch point of the applied finish. As a practical matter, the upper limit will be about 450° F.

Pressure applied to the fabric during calendering usually falls within the range of about 500 to 4,000 pounds per linear inch, preferably about 1,000 to about 2,000 pounds per linear inch, and generally the higher pressure the better. Generally, two calendering passes are used. The necessity for calendering for a specific fabric construction is determined by satisfying the taret Frazier air permeability values, as explained above.

EXAMPLE

A woven medical fabric suitable for making an isolation gown was prepared from woven 70 denier, 34 filament 100% polyester yarn woven in a plain weave pattern with a final construction of 146 ends and 85 picks per inch and a weight of 2.47 ounces per yard. The greige fabric was washed, processed to remove all foreign substances and debris, then dried. The fabric was padded and treated in a pad bath containing:

| | |
|---|---|
| water | 50% |
| citric acid | 0.1 lb. |
| isopropyl alcohol | 4 lb. |
| disperse dye | 0.25 lb. |
| Pananil Yellow P-6G | |
| Dow-Corning 5700 antimicrobial (prediluted with water 1:1) | 4 lb. |
| Aerotex CSN (American Cyanimid) antistat | 4 lb. |
| Zonyl NWG (DuPont) | 20 lb. |

to make 50 gallons. The pad bath was applied at ambient temperature at a speed of 60 yards per minute with a wet pick-up of 55% calculated on the weight of the fabric.

The fabric was then dried in a single pass in a tenter frame with a dwell time of from 30 to 60 seconds at about 425° F. Next the treated fabric was calendered at a speed of 40 yards per minute in a double nip steel over fiber roll with a surface temperature at about 350° F. and at a pressure of about 1,500 pounds per linear inch.

The finished isolation gown fabric had the following properties:

| Fabric Construction | |
|---|---|
| width (inches) | 63.1 |

-continued

| | | |
|---|---|---|
| weight (oz/yd$^2$) | 2.47 | |
| picks per inch | 85 | |
| ends per inch | 146 | |
| Properties | | |
| tensile, warp (lbs) | 164 | ASTM 1682 |
| tensile, fill (lbs) | 115 | ASTM 1682 |
| air porosity (cfm) | 0.87 | FTM-5450 |
| Suter hydrostatic (cm) | 35.5 | AATCC-127 |
| spray | 90 | AATCC-22-1980 |
| oil repellency | 4 | INDA 80.8 |
| alcohol repellency | 9 | INDA 80.9 |
| water impact (g.) | 0.25 | AATCC 42-1974 |
| bioactivity | 100% | Dow Corning-CTM-0963 |
| static decay, warp | (+)0.13 (−)0.11 | NFPA 99 |
| (sec.), fill | (+)0.21 (−)0.18 | NFPA 99 |
| crockfastness | | |
| wet | 5.0 | AATCC-8-1980 |
| dry | 5.0 | AATCC-8-1980 |
| flammability | | |
| warp | Class II | NFPA-702 |
| fill | Class II | NFPA-702 |

While we have presented a number of embodiments of this invention, it is apparent that our basic constructions and finishes can be altered to provide other embodiments which utilize the processes and compositions of this invention. The reader will appreciate that the scope of this invention is to be defined by the claimed appended here to rather than the specific embodiments and illustrations which have been presented above by way of example.

What is claimed is:

1. A woven, reusable, launderable and sterilizable polyester fabric constructed from polyester yarn of from about 50 to 150 denier and a sum of the ends and picks of at least 100 per linear inch having a finish composition containing a fluorocarbon water repellent, a flame retardant, and an antimicrobial agent applied thereto and having the following properties initially and following 100 laundering cycles:

| | Initial | After 100 Cycles |
|---|---|---|
| linting (INDA 160-0-83) particles | at most 5,000 | at most 2,000 |
| flammability (NFPA 702) | Class II | Class II |
| antimicrobial activity (CTM-0923) for Klebsiella pneumoniae | no growth | no growth |
| Suter hydrostatic resistance (AATCC-127) centimeters | at least 20.0 | at least 10.0 |
| spray rating (AATCC-22-1980) | at least 70.0 | at least 50.0 |
| air permeability (FTM 5450, Frazier method) | at most 5 | at most 10 |

2. The woven fabric of claim 1, in which the fabric has a Suter hydrostatic resistance of at least 35.0 initially and at least 20.0 after 100 cycles.

3. The woven fabric of claim 2, in which the fabric has a Suter hydrostatic resistance of at least 50.0 initially.

4. The woven fabric of claim 1, in which the fabric has an antimicrobial activity of at least 90% for *Klebsiella pneumoniae.*

5. The woven fabric of claim 1, in which the fabric has an initial oil repellency (INDA 80.8) of at least 3.

6. The woven fabric of claim 1, in which the fabric has an initial alcohol repellency (INDA 80.9) of at least 6.

7. The woven fabric of claim 1, in which the fabric has a spray rating (AATCC-22-1980) of at least 70.

8. A woven isolation gown, surgical gown, surgical scrub suit, sterilization wrapper, cover gown, isolation gown, hamper bag, jump suit, work apron or laboratory coat constructed of the fabric of any one of claims 1, 2, 5, 6 or 7.

9. A woven polyester medical fabric constructed from polyester yarn of about 50 to 150 denier and a sum of ends and picks of at least 100 per linear inch having a finish composition containing a fluorocarbon water repellent, a flame retardant, and an antimicrobial agent applied thereto and having the following properties initially and following 100 laundering and steam sterilization cycles:

| | Initial | After 100 Cycles |
|---|---|---|
| linting (INDA 160-0-83, particles) | at most 5,000 | at most 2,000 |
| flammability (NFPA 702) | Class II | Class II |
| steam penetration | yes | yes |
| antimicrobial activity (CTM-0923) | no growth | no growth |
| Suter hydrostatic resistance (AATCC-127) | at least 35.0 | at least 10.0 |
| spray rating (AATCC-22-1980) | at least 70.00 | at least 50.0 |
| air permeability (FMT 5450, Frazier method) | at most 5 | at most 10 |

10. The woven medical fabric of claim 9, in which the fabric has an initial Suter hydrostatic resistance of at least 50.0.

11. The woven medical fabric of claim 9, in which the fabric has an initial oil repellency (INDA 80.8) of at least 3.

12. The woven medical fabric of claim 9, in which the fabric has an initial alcohol repellency (INDA 80.9) of at least 6.

13. The woven medical fabric of claim 9, in which the fabric has a spray rating (AATCC-22-1980) of at least 70.

14. A woven, reusable, launderable and sterilizable isolation gown, surgical gown, surgical scrub suit, sterilization wrapper, cover gown, isolation gown, hamper bag, jump suit, work apron or laboratory coat constructed of the medical fabric of any one of claims 9, 10, 11, 12 or 13.

* * * * *